United States Patent [19]

Dieter, Jr. et al.

[11] 4,326,285

[45] Apr. 20, 1982

[54] STEREO PHONOGRAPH CARTRIDGE

[75] Inventors: Norman H. Dieter, Jr., Pleasantville; Edward Peterhoff, Nanuet, both of N.Y.

[73] Assignee: Micro-Acoustics Corporation, Elmsford, N.Y.

[21] Appl. No.: 136,320

[22] Filed: Apr. 1, 1980

[51] Int. Cl.[3] ..... H04R 17/08

[52] U.S. Cl. ..... 369/137; 369/139

[58] Field of Search ..... 369/136, 137, 138, 139, 369/144; 310/327, 320, 321, 323

[56] References Cited

U.S. PATENT DOCUMENTS

| | | | |
|---|---|---|---|
| 2,707,755 | 5/1955 | Hardie et al. | 310/327 |
| 2,881,336 | 4/1959 | Elion | 310/327 |
| 3,055,989 | 9/1962 | Bachman et al. | 369/144 |
| 3,946,149 | 3/1976 | White | 369/144 |
| 3,952,171 | 4/1976 | Dieter, Jr. | 369/139 |
| 3,975,025 | 8/1976 | Obata et al. | 369/138 |
| 3,976,830 | 8/1976 | Glenn | 369/144 |
| 4,053,721 | 10/1977 | Nishikawa | 369/138 |

FOREIGN PATENT DOCUMENTS

| | | | |
|---|---|---|---|
| 455400 | 10/1975 | Fed. Rep. of Germany | 369/137 |
| 37-16074 | 10/1962 | Japan | 369/137 |

*Primary Examiner*—Raymond F. Cardillo, Jr.
*Attorney, Agent, or Firm*—Kenyon & Kenyon

[57] ABSTRACT

In order to improve the performance of a stereo phonograph cartridge which includes a base, first and second piezoelectric transducers, first and second individual elastomeric blocks mounting the first and second transducers to the base depending downwardly in a cantilevered manner in horizontal spaced relationship, first and second separate elastomeric stabilizers mounted to the base in horizontal spaced relationship with each other and directly below the first and second transducers, a resolver having four connecting points contacting respectively to the first and second transducers and the first and second stabilizers, a pivot anchor coupling the resolver in a tensioned manner to the base, the pivot anchor being attached to the resolver at a point which is equidistant from each of the four connecting points, and a stylus bar extending from the resolver along the axis of the pivot anchor, the stylus diameter is reduced to thereby reduce stylus mass, the size of the resolver and stabilizers is reduced to permit reducing the vertical tracking angle between the stylus and the record surface, and the elastomeric stiffness of the stabilizers and transducer mounting is reduced and, to compensate for the rise and fall in cartridge output and the imbalance between vertical and lateral output caused by these measures, an elastomeric coupler is inserted between each transducer and its associated coupling point, a dynamic resonant damper is attached to the side of the transducer opposite each coupling point and a dynamic balancing weight inserted in the resolver.

6 Claims, 10 Drawing Figures

SIDE VIEW

REAR VIEW

SIDE VIEW

FRONT VIEW

STEREO PHONOGRAPH CARTRIDGE

BACKGROUND OF THE INVENTION

This invention relates to stereo phonograph cartridges in general and more particularly to improved structural devices for precisely controlling vibrations involved in accurately converting record signal vibrations to their precise electrical analogs.

U.S. Pat. No. 3,952,171 discloses a stereo phonograph cartridge which utilizes a resolver with four contact points to provide improved performance. The resolver has a stylus bar extending therefrom and resolves the motion of the stylus bar into the two stereo components. Rotation of the resolver is about a pivot point and a specific manner of damping is provided by means of stabilizers at two of the points, with the other two points contacting transducers. Although this system works quite well, there is room for improvement in its performance.

In view of this, it is the object of the present invention to improve the cartridge structure described in U.S. Pat. No. 3,952,171 such as to provide a cartridge which more accurately converts record signal vibrations to their precise electrical analogs.

SUMMARY OF THE INVENTION

In the aforementioned patent, the angle between the stylus bar centerline and record surface is defined as the vertical tracking angle. For minimum playback distortion this angle must match the vertical angle between the recording head and original master record surface. To improve the performance of the cartridge of the aforementioned patent, it is desirable to reduce the angle. However, care must be taken to allow sufficient clearance between the record surface and the cartridge body. Thus, in accordance with one feature of the improvement of the present invention, the size of the resolver and stabilizers is reduced to permit a reduction of this angle while still retaining sufficient clearance. As a result playback distortion is reduced.

Another factor which affects the accuracy of reproduction is the effect of stylus mass. Improvement will be obtained by reducing this mass through a reduction of the weight of the stylus bar. Since the stylus bar length cannot be reduced without reducing record clearance, a reduction in mass can be obtained only by reducing the diameter. In accordance with the present invention the diameter is reduced from 0.014 inches to 0.010 inches. By reducing the beryllium stylus bar in this manner and using a small stylus the effective stylus mass is reduced by 50%. However, this reduction in stylus size results in a reduction of 50% in the stylus bar stiffness, producing an undesirable change in performance, i.e., a negative effect on performance. Furthermore, cartridge compliance is increased in accordance with the present invention by reducing the elastomeric stiffness of the stabilizers and transducer supporting blocks.

The changes just noted produce the desired improvements. However, a high quality phonograph cartridge is a delicately balanced system of interrelated components and thus, it is not unexpected that the making of such changes will produce poor performance in other related aspects. If such changes were made without going further, the result would be a poor performance in frequency response between 10 kHz and 30 kHz due primarily to the large reduction in stylus bar stiffness and secondarily to the reduced stabilizer and supporting block stiffness. The changes in frequency response resulting would be as follows: (a) a rising and falling cartridge output between 10 kHz and 20 kHz; and (b) an imbalance between lateral and vertical frequency response between 20 kHz and 30 kHz.

In accordance with the present invention, these undesirable effects are eliminated by inserting an elastomeric block or "coupler" between the transducer and the resolver at each coupling point, the block being fastened to the transducer. When stylus signal vibrations are transmitted via the stylus bar and resolver through the elastomeric couplers to the transducers, at the frequency of the rise and fall in frequency response noted above, the force and amplitude of motion increases at the coupling points and the couplers dissipate more energy relative to motions at lower or higher frequencies. This reduces the rise and fall partially improving cartridge compliance and giving more reliable coupling connection to the transducer. Secondly, a pair of auxiliary mass-spring mechanical resistance systems or dynamic resonant dampers are provided, one for each channel, each comprising a mass attached to one end of an elastomeric bar which is attached to the transducer. Through these two measures, the first noted problem, the rise and fall of cartridge output between 10 kHz and 20 L kHz is overcome.

The second problem, i.e., the imbalance between lateral and vertical frequency response between 20 kHz and 30 kHz, is overcome through the use of a dynamic balancing weight attached to the resolver so that it is located the same distance below the pivot as the transducer mass is located above the pivot in the vertical sense and directly below the pivot in the lateral motion sense. This results in a cartridge output for vertical signals which is equal to the output for equal lateral signals thereby correcting for the imbalance between lateral and vertical frequency response.

DETAILED DESCRIPTION OF THE INVENTION

As noted above, to improve cartridge performance, the mass of the stylus bar is reduced, the size of the resolver reduced and the stiffness of elastomeric stabilizers and transducers supporting blocks reduced.

Figure 1A:
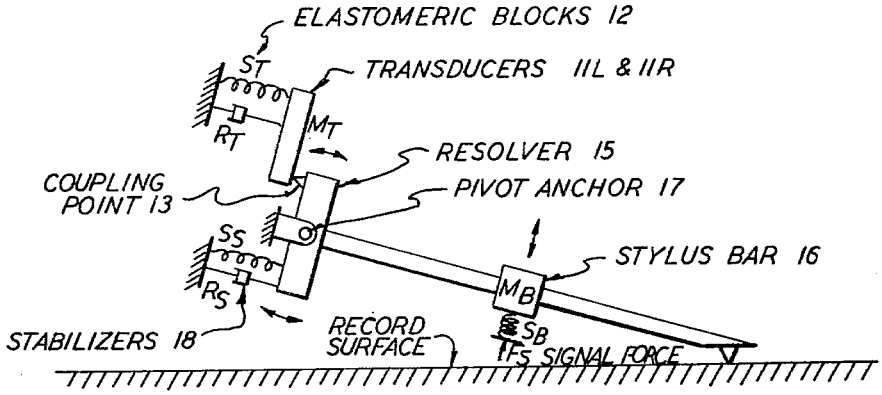
FIGS. 1*a* and 1*b* are schematic diagrams illustrating the mechanics which lead to a rise and fall in cartridge output and the measures taken to correct the rise and fall.

FIG. 1*a* is a diagram which illustrates the mechanics leading to a rise and fall in cartridge output between 10 kHz and 20 kHz which results from taking these steps. The construction of the system herein is generally as described in the aforementioned U.S. Patent. The structure includes a stylus bar 16 which extends out from a resolver 15, the resolver and stylus bar pivoting about an anchor 17. The resolver 15 has four contact points.

At the bottom, it is coupled through two stabilizers 18 to the base structure of the cartridge. At the top, the two points are in the form of coupling points 13 which contact transducers 11L and 11R which are attached to the base of the cartridge by means of elastomeric blocks 12. Because of the pivot anchor 17, the only type of motion of which the resolver is capable is a rotational motion. FIG. 1*a* illustrates the forces and masses involved. The transducer mass is designated as $M_T$. This represents the equivalent mass of the two transducers referred to the coupling points 13. $S_T$ and $R_T$ respectively represent the stiffness and mechanical resistance of the elastomeric blocks 12, again referred to the coupling points. $S_S$ and $R_S$ are the stiffness and mechanical resistance of the stabiliziers 18. $M_B$ and $S_B$ are the equivalent mass and stiffness of the stylus bar 16 referred to the pivot point 17.

This system will vibrate at a frequency dictated by the combined effects of the masses and springs. In this case $M_T$ is much greater than $M_B$ and $S_B$ is much greater than $S_T+S_S$. The resonant frequency thus is primarily a function of $M_T$, the transduced mass and $S_B$ the stylus bar stiffness. During playback the transducer motion will increase at this resonant frequency and an increased output will result. This is the rise and fall in frequency which occurs between 10 kHz and 20 kHz referred to above. If $S_B$ is large enough, as is the case with the stylus bar having a diameter of 0.014 and the damping effects of $R_T$ and $R_S$ are sufficient, the rise and fall in frequency response is small and at a sufficiently high frequency to provide adequate playback performance. However, when the stylus bar diameter is reduced to 0.010 inches and its stiffness is reduced by approximately 50%, the rise and fall occur at a lower frequency and are large enough to be objectionable. In order to achieve the improvements which are obtained by reducing the mass of the stylus bar, it is necessary that this undesired response be eliminated by means other than an increase in stylus bar diameter or length or an increase in $S_S$ or $S_T$.

Figure 1B:
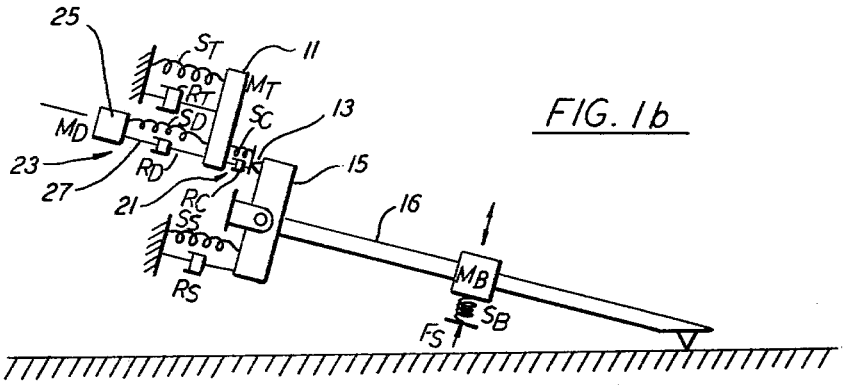

FIG. 1*b* illustrates the manner in which the present invention eliminates this objectionable rise and fall. In accordance with the present invention, between each coupling point 13 at the resolver 15 and its associated transducer 11, an elastomeric block or coupler 21 is disposed. In FIG. 1*b* the stiffness and resistance of the couplers 21 is indicated on FIG. 1*b* as $S_C$ and $R_C$. All stylus signal vibrations are transmitted through the stylus bar and resolver and then through the elastomeric couplers to the transducers. At the frequency of the rise and fall in frequency response noted above, the force and amplitude of motion increases at the coupling points and the couplers will dissipate more energy relative to motions at lower or higher frequencies. This partially reduces the rise and fall. In addition cartridge compliance is improved and a more reliable coupling connection to the transducer is achieved.

To further overcome this problem, an auxiliary mass-spring-mechanical resistance system or dynamic resonant damper 23 is provided, one for each channel. These comprise a mass 25 attached to one end of an elastomeric bar 27 which is attached to the transducer. This is indicated schematically in FIG. 1*b*, the mass 25 being indicated by the symbol $M_D$ and the elastomeric bar 27 being represented in terms of its stiffness and resistance by $S_D$ and $R_D$. At the resonant frequency of this auxiliary system, the motions of $M_T$ and $M_D$ are in opposite directions resulting in a maximum absorption of energy by $R_D$ and a reduction in energy transmitted to the transducers. By adjusting the values of $M_D$ and $S_D$, the resonant frequency of the auxiliary system is matched to the frequency of the rise and fall noted above. By adjusting the value of $R_D$ as well, the rise and fall is eliminated. These dynamic resonant dampers 23 have an additional advantage. At low frequencies of stylus signal motions, cartridge compliance remains a function of the elastomeric block stiffness of the stabilizers and transducers and is thus not reduced.

Figure 2A:
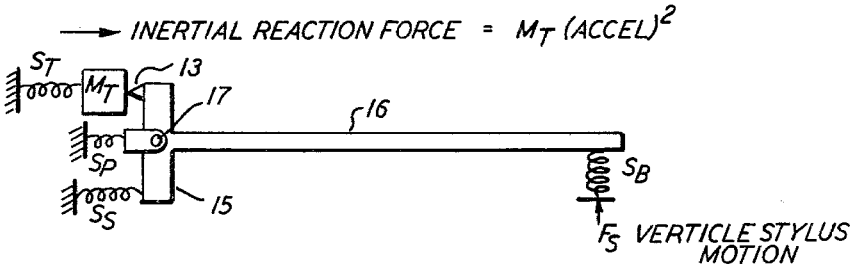
FIGS. 2*a*–2*d* are schematic diagrams which illustrate the factors leading to an imbalance between lateral and vertical frequency response and the measures taken to correct the imbalance.
Figure 2B:
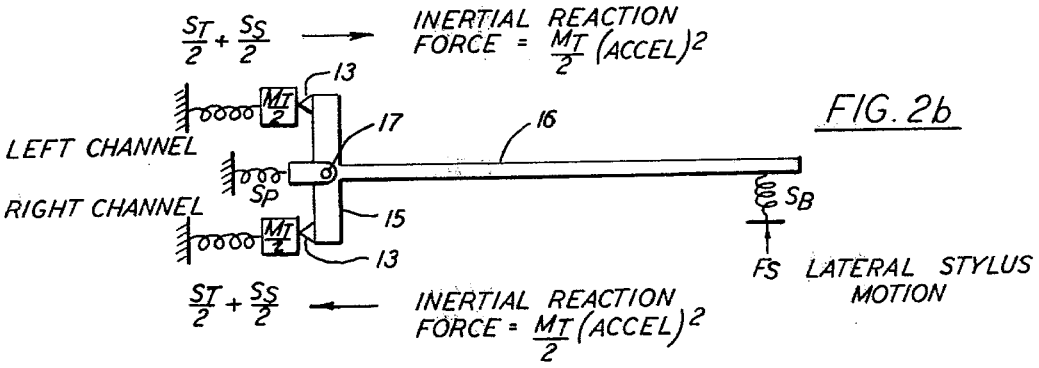

FIGS. 2*a* and 2*b* illustrate the imbalance between lateral and vertical frequency response. FIG. 2*a* is essentially a schematic elevation view of the stylus and FIG. 2*b* a schematic plan view. The frequencies of interest are between 20 kHz and 30 kHz. At these frequencies the transducer mass $M_T$ and the pivot anchor stiffness $S_P$ control the transducer motion. For a given vertical stylus motion the total inertial reaction force at the coupling points 13 for the resulting acceleration a is $M_Ta^2$. For a lateral stylus motion of the same magnitude and frequency as for the vertical case, in a direction acting on the left channel, the inertial reaction at the right channel coupling point is zero since the resolver is not attached to the transducer. For vertical stylus motion in this frequency range the pivot anchor receives twice the tensile force and therefore elongates twice as much for the case of lateral signals of the same magnitude and frequency. As a result, cartridge output for vertical signals will be less than the output for equal lateral signals. This then is the imbalance referred to above.

Figure 2C:
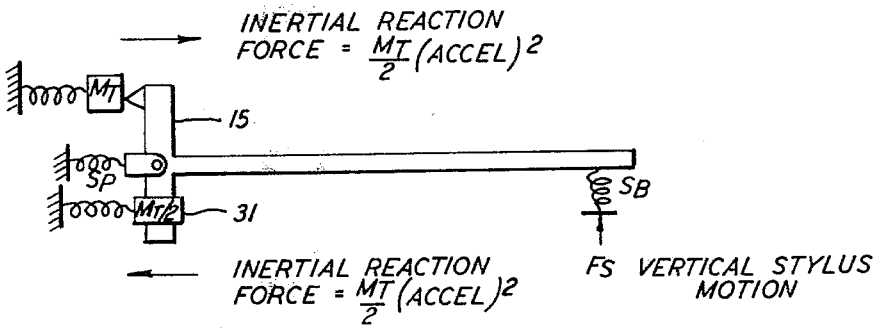
Figure 2D:
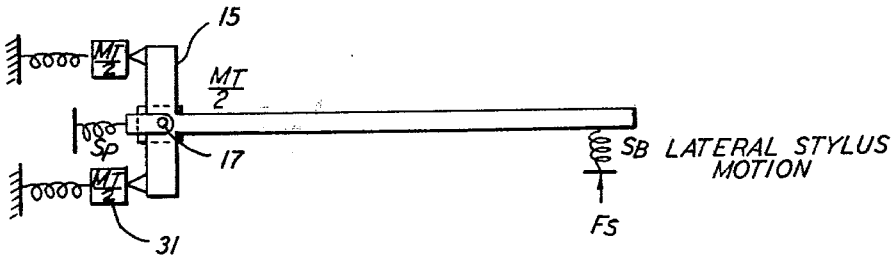

This effect could be reduced by increasing the stiffness involved. However, this would be a change counter to the improvements noted above. The correction of this imbalance without compromising cartridge performance involves another device which is illustrated in FIGS. 2*c* and 2*d*. Referring to FIG. 2*c*, a dynamic balancing weight 31 with a mass of $M_T/2$ is attached to the resolver 15 so that it is located the same distance below the pivot 17 as $M_T$ is located above the pivot in the vertical motion diagram of FIGS. 2*a* and 2*c* and directly below the pivot in the lateral motion diagrams of FIGS. 2*b* and 2*d*. For a given vertical stylus motion, the total inertial reaction force is $M_Ta^2-M_Ta^2/2$ or $M_Ta^2/2$. For a lateral stylus motion of the same magnitude and frequency the total reaction force is, as before, $M_Ta^2/2$ and is equal to the vertical case. The cartridge output for vertical signals is now equal to the output for equal lateral signals and the imbalance is eliminated.

Figure 3A:
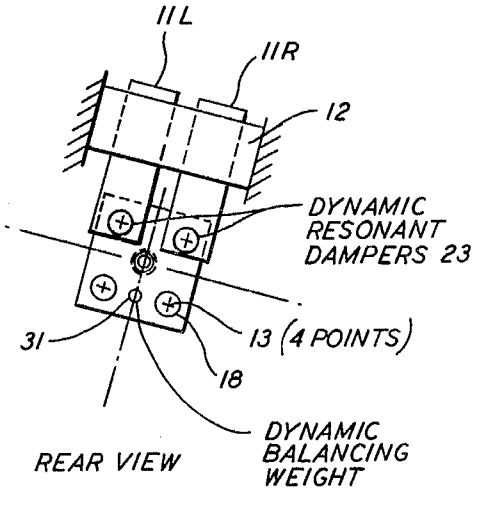
FIGS. 3*a, b* and *c* are diagrams illustrating the construction of a cartridge according to the present invention.
Figure 3B:
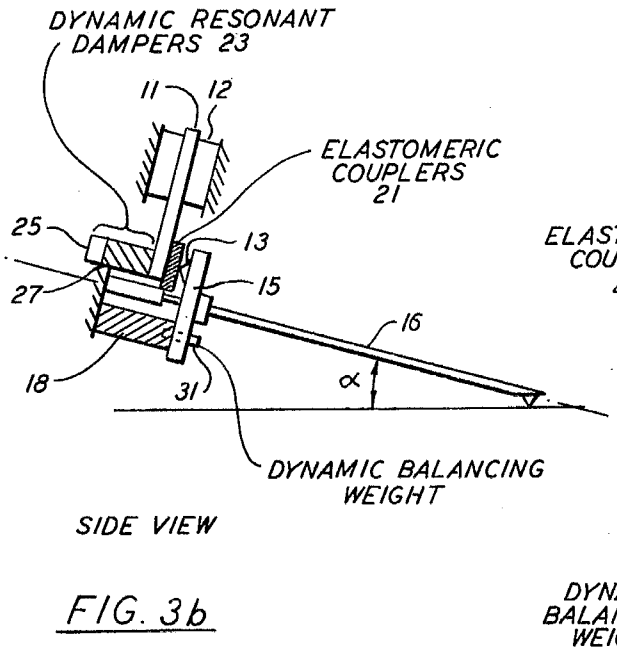
Figure 3C:
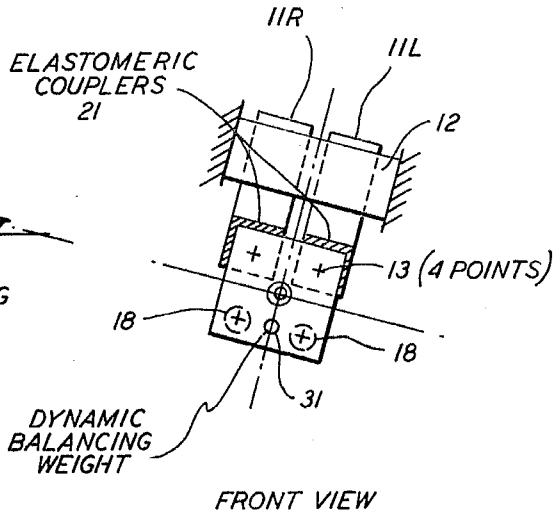

FIGS. 3*a*, *b* and *c* are rear, side and front views, respectively of the cartridge system of the present invention illustrating the various elements. In general, the design is similar to that of the aforementioned U.S. Patent with the changes noted above. As indicated previously, in order to improve the vertical tracking angle a indicated on FIG. 3*b* the size of the resolver 15 has been reduced. This allows decreasing the angle while still maintaining clearance from the surface of the record. In addition, the diameter of the stylus bar 16 has been reduced from 0.014 inches to 0.010 inches and, with a smaller stylus, reduces the effective stylus mass by about 50%. In addition, cartridge compliance is increased by reducing the elastomeric stiffness of the stabilizers 18 and the transducer support blocks 12. As discussed above, in order to overcome the negative performance characteristics associated with these changes there is first of all inserted between each of the two coupling points 13 to the transducers 11L and 11R an elastomeric coupler 21. Secondly, there is attached to the transducers 11 dynamic resonant dampers 23 comprising a mass 25 on the end of an elastomeric bar 27. Finally, to compensate for the imbalance between lateral and vertical frequency response there is disposed in the resolver a dynamic balancing weight 31.

The elastomeric couplers 21 are butyl rubber pieces 0.03 inches square and 0.020 inches thick and are fastened to each transducer at the coupling points 13. The dynamic resonant dampers consist of a cylinder of butyl rubber 0.050 inches in diameter and 0.060 inches long and are fastened to each transducer at a point near the coupling points 13. The dynamic balancing weight 21 is 0.015 inches in diameter and 0.020 inches long and is fastened in the hole in the resolver in line with the coupling points and on the vertical center line of the pivot anchor. In practice, a platinum weight is used to provide a correct mass in a concentrated space. The resolver is approximately 0.072 inches square. As previously noted, the stylus bar has a diameter of 0.010 inches.

Figure 4:
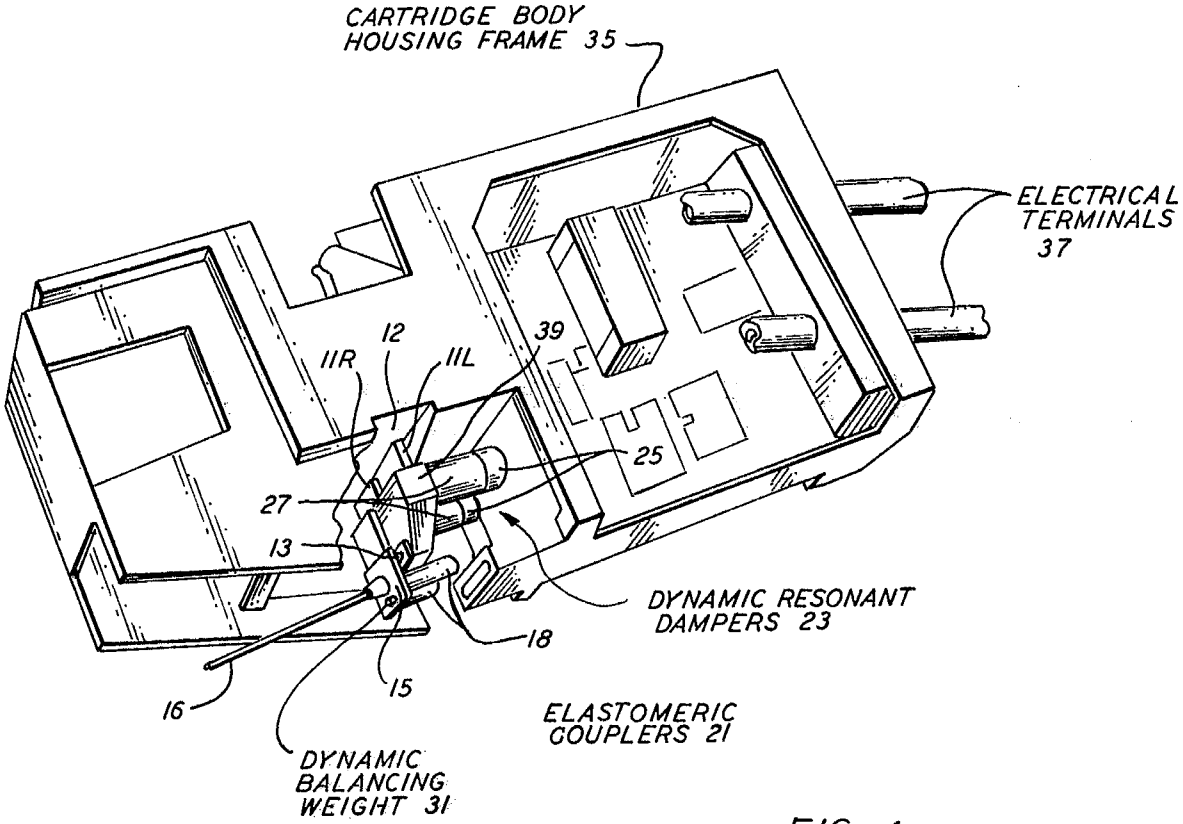
FIG. 4 is a perspective view of the cartridge according to the present invention.

These elements are also shown in the perspective view of FIG. 4. The system is disposed on a cartridge body 35 having protruding electric terminals 37 in conventional fashion. The transducers 11L and 11R are suspended from the housing frame 35 supported in the elastomeric blocks 12. Each of the transducers is surrounded by a cap 39. Shown is the stylus bar 16 extending from the resolver. Also evident on the figure are the stabilizers 18 at the two lower coupling points of the resolver extending between the resolver and the cartridge body. The two upper coupling points 13 are shown coupling to the transducers 11R through the elastomeric couplers 21 which are disposed between the coupling points 13 and the caps 39 on the transducers. Also shown extending from the transducers are the dynamic resonant dampers 23 comprising elastomeric bars 27 with weights 25 at their ends. Also visible on the figure is the dynamic balancing weight 31 in the resolver 15.

Although specific sizes, shapes and materials have been given for the specific example detailed above, it will be recognized that the principles of the present invention can be used in other types of resolvers with other material sizes and shapes employed.

What is claimed is:

1. In a stereo phonograph cartridge comprising:

a. a base;

b. first and second piezoelectric transducers;

c. first and second individual elastomeric means mounting said first and second transducers to said base depending downwardly in a cantilevered manner in horizontal spaced relationship;

d. first and second separate elastomeric stabilizers mounted to said base in horizontal spaced relationship with each other and directly below said first and second transducers;

e. a resolver having four connecting points coupled respectively to said first and second transducers and said first and second stabilizers;

f. a pivot anchor, stressed in tension, extending between said resolver and said base, said pivot anchor being attached to said resolver at a point which is equidistant from each of said four connecting points; and g. a stylus bar extending from said resolver along the axis of said pivot anchor, the improvement comprising:

h. elastomeric coupling pads disposed between each of said transducers and their associated connecting points; and i. an elastomeric bar attached to each of said transducers on the side opposite said coupling point, said elastomeric bar having one end attached to its associated transducer and a weight on the other end of said elastomeric bar.

2. The improvement according to claim 1 and further including a dynamic balancing weight in said resolver, said dynamic balancing weight having a mass which is one half the effective mass of the transducers at the connecting points, said weight located the same distance below said pivot as the effective mass of said transducers is above the pivot and virtually directly below said pivot.

3. A method of improving the performance of a stereo phonograph cartridge which comprises:

a. a base;

b. first and second piezoelectric transducers;

c. first and second individual elastomeric means mounting said first and second transducers to said base depending downwardly in a cantilevered manner in horizontal spaced relationship;

d. first and second separate elastomeric stabilizers mounted to said base in horizontal spaced relationship with each other and directly below said first and second transducers;

e. a resolver having four connecting points coupled respectively to said first and second transducers and first and second stabilizers;

f. a pivot anchor, stressed in tension, extending between said resolver and said base, said pivot anchor being attached to said resolver at a point which is equidistant from each of said four connecting points; and g. a stylus bar extending from said resolver along the axis of said pivot anchor, comprising:

(i) reducing the stylus diameter to thereby reduce stylus mass;

(ii) reducing the size of the resolver and stabilizers to permit reducing the vertical tracking angle between the said stylus and the record surface;

(iii) reducing the elastomeric stiffness of said stabilizers and transducer mounting means; and (iv) compensating for the rise and fall in cartridge output caused by steps (i), (ii) and (iii) by inserting an elastomeric coupler between each transducer and its associated coupling point and by attaching to the side of said transducer opposite each coupling point a dynamic resonant damper, comprising an elastomeric bar having on the end thereof a weight.

4. The improvement according to claim 3 wherein the mass, stiffness and resistance of said dynamic resonant dampers are adjusted to result in a resonant frequency for said damper which is matched to the frequency of the rise and fall and of equal amplitude, whereby said rise and fall will be cancelled.

5. The method according to claim 3 and further including correcting an imbalance between lateral and vertical frequency response resulting from steps (i), (ii) and (iii) by inserting a dynamic balancing weight in said resolver.

6. The improvement according to claim 5 comprising selecting said dynamic balancing weight to have a mass which is equal to one half the effective mass of the transducers at the connecting points, and locating said mass directly below said pivot point a vertical distance equal to the vertical distance of said connecting points above said pivot point.

* * * * *